US010077650B2

(12) United States Patent
Parkin et al.

(10) Patent No.: US 10,077,650 B2
(45) Date of Patent: Sep. 18, 2018

(54) CONTINUOUS DOWNLINKING WHILE DRILLING

(71) Applicant: SCHLUMBERGER TECHNOLOGY CORPORATION, Sugar Land, TX (US)

(72) Inventors: Edward George Parkin, Cheltenham (GB); Christopher C. Bogath, Richmond, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 357 days.

(21) Appl. No.: 14/945,549

(22) Filed: Nov. 19, 2015

(65) Prior Publication Data

US 2016/0145992 A1 May 26, 2016

Related U.S. Application Data

(60) Provisional application No. 62/082,496, filed on Nov. 20, 2014.

(51) Int. Cl.

| | |
|---|---|
| ***E21B 3/00*** | (2006.01) |
| ***E21B 44/02*** | (2006.01) |
| ***E21B 44/06*** | (2006.01) |
| ***E21B 47/12*** | (2012.01) |
| ***E21B 44/00*** | (2006.01) |

(52) U.S. Cl.

CPC ..... *E21B 47/12* (2013.01); *E21B 44/00* (2013.01)

(58) Field of Classification Search

CPC ..... E21B 44/00; E21B 47/18; E21B 47/187; E21B 44/02; E21B 47/12

See application file for complete search history.

(56) References Cited

U.S. PATENT DOCUMENTS

| | | | | |
|---|---|---|---|---|
| 5,448,227 | A * | 9/1995 | Orban | E21B 7/068 175/40 |
| 6,026,912 | A | 2/2000 | King et al. | |
| 6,920,085 | B2 | 7/2005 | Finke et al. | |
| 7,198,102 | B2 | 4/2007 | Virally et al. | |
| 8,044,821 | B2 | 10/2011 | Mehta | |
| 8,196,678 | B2 | 6/2012 | Jeffryes | |
| 8,570,833 | B2 | 10/2013 | Sugiura | |
| 8,746,366 | B2 | 6/2014 | Patwa et al. | |
| 8,749,399 | B2 | 6/2014 | Petrovic et al. | |
| 2008/0066958 | A1 | 3/2008 | Haci et al. | |
| 2011/0286309 | A1 | 11/2011 | Sugiura | |
| 2013/0220602 | A1 | 8/2013 | Patwa et al. | |

(Continued)

FOREIGN PATENT DOCUMENTS

EP 0617196 A2 9/1994

OTHER PUBLICATIONS

International Search Report and Written Opinion issued in related International Application No. PCT/US2015/061688 dated Feb. 15, 2016 (12 pages).

*Primary Examiner* — Daniel P Stephenson

(57) ABSTRACT

A method for continuous downlinking from a surface location to a bottom hole assembly includes using a bottom hole assembly to drill a subterranean wellbore. A drilling value is acquired at a surface location while drilling. The acquired drilling value is downlinked from the surface location to the bottom hole assembly. This process is continuously repeated while drilling.

22 Claims, 4 Drawing Sheets

(56) References Cited

U.S. PATENT DOCUMENTS

| | | | | |
|---|---|---|---|---|
| 2013/0341091 | A1* | 12/2013 | Sugiura | E21B 7/04 175/24 |
| 2014/0027174 | A1 | 1/2014 | Ringer et al. | |
| 2014/0036629 | A1 | 2/2014 | Sugiura | |
| 2014/0291024 | A1 | 10/2014 | Sugiura et al. | |
| 2016/0145992 | A1* | 5/2016 | Parkin | E21B 44/00 175/38 |

* cited by examiner

CONTINUOUS DOWNLINKING WHILE DRILLING

CROSS REFERENCE TO RELATED APPLICATIONS

This application claims the benefit of U.S. Provisional Patent Application Ser. No. 62/082,496 entitled Continuous Downlinking While Drilling, which was filed on Nov. 20, 2014.

FIELD OF THE INVENTION

Disclosed embodiments relate generally to downhole communications and more particularly to methods for continuously downlinking information from the surface to a downhole tool while drilling.

BACKGROUND INFORMATION

Modern downhole drilling techniques may be enhanced via two-way communication between the surface and a bottom hole assembly (BHA). In many drilling operations digital data is continuously streamed from the BHA to the surface at data rates in a range from about 1 to about 20 bits per second (e.g., using mud pulse telemetry or a mud siren). However, known downlinking methods (methods for transmitting information from the surface to the BHA) are generally slow (e.g., on the order of 1 to 2 bits per minute) and discontinuous (e.g., implemented when the drill bit is off bottom or to transmit a discrete command).

While conventional downlinking methods may be implemented while drilling, such an implementation tends to require significant changes (modulation) to the drilling fluid (mud) flow rate and/or the drill string rotation rate which can negatively impact the drilling process. For example, significant changes to the mud flow rate may adversely affect bit cleaning, hole cleaning, directional capability, and BHA power generation. Significant changes to the drill string rotation rate may adversely affect the rate of penetration and drill string dynamics (modes of vibration). Electromagnetic telemetry methods may also sometimes be used; however, these methods can also have bandwidth limitations and may be limited to fields having suitable well depths and formation resistivity. There is thus room in the art for improved downlinking methods, particularly methods that provide for continuous downlinking while drilling without adversely affecting the drilling process.

SUMMARY

A method for continuous downlinking a drilling value from a surface location to a bottom hole assembly while drilling is disclosed. The method includes using a bottom hole assembly to drill a subterranean wellbore. A drilling value is acquired at a surface location while drilling. The acquired drilling value is downlinked from the surface location to the bottom hole assembly while drilling via modulating a drilling parameter. This process is continuously repeated while drilling. In optional embodiments, the disclosed methods may further include establishing a mathematical relationship between the acquired drilling value and the modulated drilling parameter in which the mathematical relationship is a repeating function.

The disclosed embodiments may provide various technical advantages. For example, the disclosed methods provide for continuous downlinking from the surface to the BHA while drilling. This tends to improve the information available to the downhole tools, for example, via providing a stream of continuous parameter values while drilling. Time based, closed-loop methods (such as derivative and integral control) for directional drilling and steering control may be particularly enhanced, for example, via downlinking a continuous rate of penetration to the BHA.

The disclosed methods tend to be further advantageous in that they don't require significant modulation of the drilling parameters and therefore tend not to significantly impact the drilling performance. Moreover, the disclosed methods may be used concurrently with other conventional downlinking methodologies and have little or no effect on uplink telemetry methods. Still further the disclosed methods may enable data to be downlinked in analog form using continuous modulation thereby substantially eliminating quantization errors.

This summary is provided to introduce a selection of concepts that are further described below in the detailed description. This summary is not intended to identify key or essential features of the claimed subject matter, nor is it intended to be used as an aid in limiting the scope of the claimed subject matter.

BRIEF DESCRIPTION OF THE DRAWINGS

For a more complete understanding of the disclosed subject matter, and advantages thereof, reference is now made to the following descriptions taken in conjunction with the accompanying drawings, in which.

DETAILED DESCRIPTION

Figure 1:
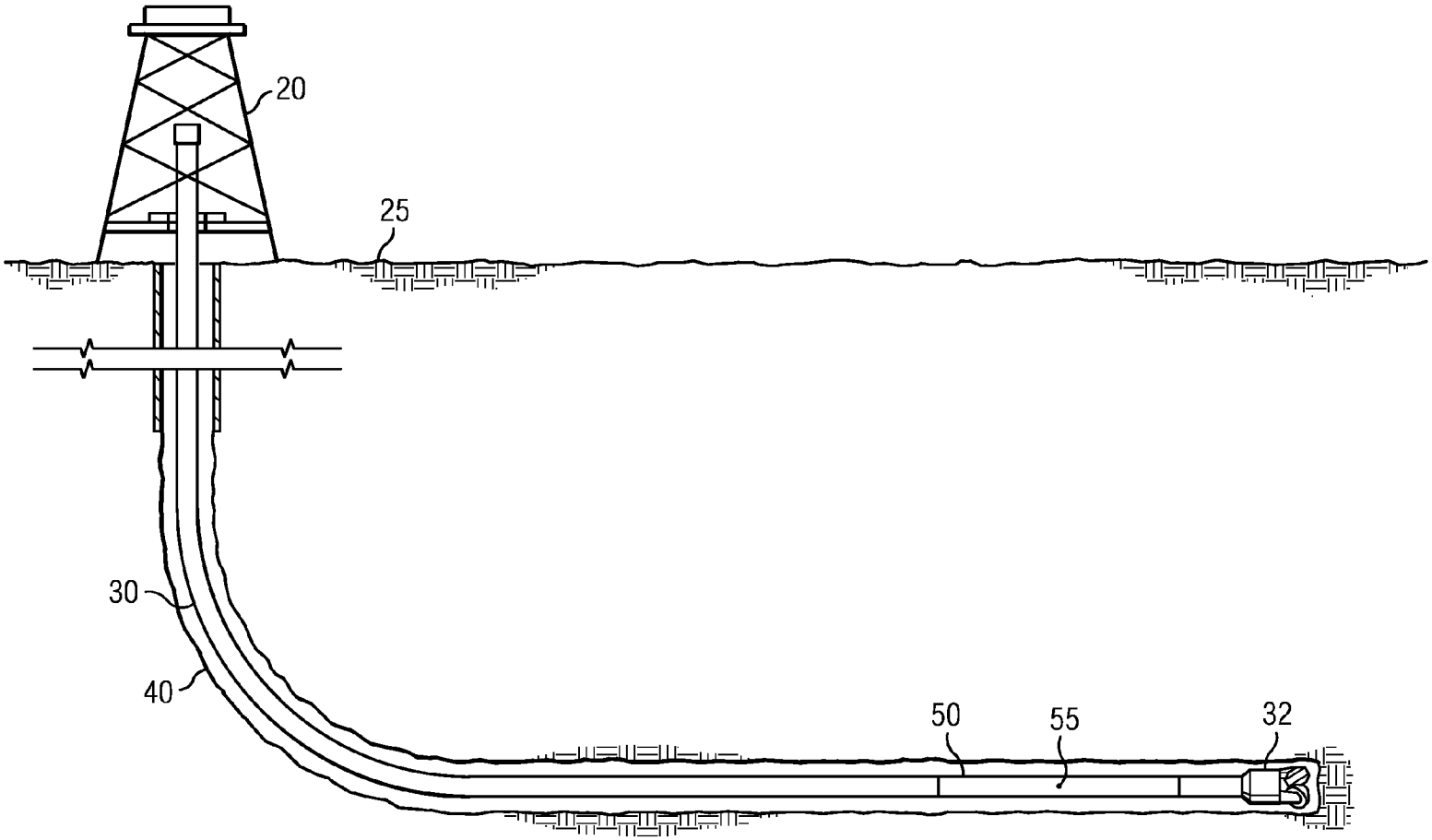
FIG. 1 depicts one example of a conventional drilling rig on which disclosed methods may be utilized.

FIG. 1 depicts a drilling rig 20 suitable for using various method embodiments disclosed herein. The rig may be positioned over an oil or gas formation (not shown) disposed below the surface of the earth 25. The rig 20 may include a derrick and a hoisting apparatus for raising and lowering a drill string 30, which, as shown, extends into wellbore 40 and includes a drill bit 32 and a downhole processor 55 configured to receive a downlinking signal from the surface (i.e., from the rig). The downhole processor 55 may be deployed in substantially any suitable downhole tool 50, for example, including a rotary steerable tool, a logging while drilling tool, a measuring while drilling tool, or a downhole telemetry tool. Drill string 30 may further include substantially any other suitable downhole tools for example including a downhole drilling motor, a steering tool, a downhole telemetry system, and one or more MWD or LWD tools including various sensors for sensing downhole characteristics of the borehole and the surrounding formation. The disclosed embodiments are not limited in these regards.

While not depicted on FIG. 1 the drilling rig may include a rotary table or a top drive for rotating the drill string 30 (or other components) in the borehole. The rig may further include a swivel that enables the string to rotate while maintaining a fluid tight seal between the interior and exterior of the pipe. During drilling operations mud pumps draw drilling fluid ("mud") from a tank or pit located at or near the rig and pump the mud through the interior of the drill string to the drill bit where it lubricates and cools the bit and carries cuttings to the surface. The mud flow may also drive a downhole turbine to generate electrical power in the BHA. Such equipment is well known to those of ordinary skill in the art and need not be discussed in further detail herein.

The drilling rig may also include various surface sensors (also not illustrated on FIG. 1) for measuring and/or monitoring rig activities and drilling values. These sensors may include, for example, (i) a hook load sensor for measuring the weight (i.e., the load) of the string on the hoisting apparatus from which a weight-on-bit (WOB) may be computed, (ii) a block position sensor for measuring the vertical position of the travelling block (or the top of the pipe stand) in the rig as various components are raised and lowered in the borehole from which a rate of penetration (ROP) of the drill bit during drilling may be computed, (iii) a drilling fluid pressure sensor for measuring the pressure of drilling fluid pumped downhole, and (iv) a torque sensor for measuring the torque applied by the top drive or rotary table. Such surface sensors are also well known in the industry and need not be discussed in detail.

Figure 2:
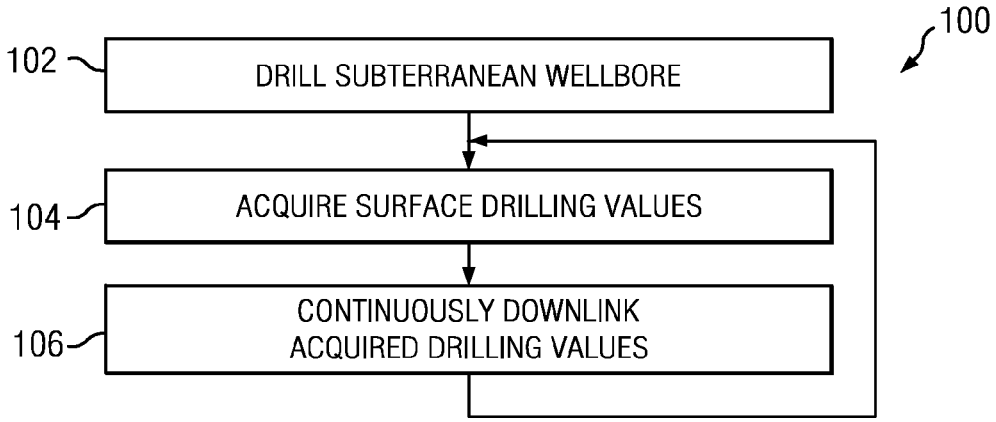
FIG. 2 depicts a flowchart of an example method embodiment.

FIG. 2 depicts a flow chart of one disclosed method embodiment 100 for continuously downlinking drilling information from the surface to a downhole tool. A drill string (such as drill string 30 depicted on FIG. 1) is deployed in and used to drill a subterranean wellbore at 102, for example, via rotating the drill string and/or pumping drilling fluid downhole to power a mud motor. One or more drilling values are continuously acquired (e.g., measured, derived, or otherwise received) at the surface at 104 while drilling. The acquired drilling values may include, for example, weight on bit, rate of penetration, applied torque, measured depth, and the like. One or more of the acquired drilling values are downlinked from the surface to a downhole tool (or controller) at 106. The acquiring and downlinking are continuously repeated such that the acquired values are continuously downlinked (as depicted). By continuously acquired and continuously downlinked it is meant that the drilling values are acquired at the surface and downlinked at a desired interval (or intervals). It will be understood that the depicted embodiment is not limited to any particular downlinking interval. For example, the drilling parameter may be continuously acquired at 104 at a first interval (such as a 1 sec interval) and averaged over a second interval (such as a 1 min interval). These averaged values may then be continuously downlinked at 106.

Figure 3:
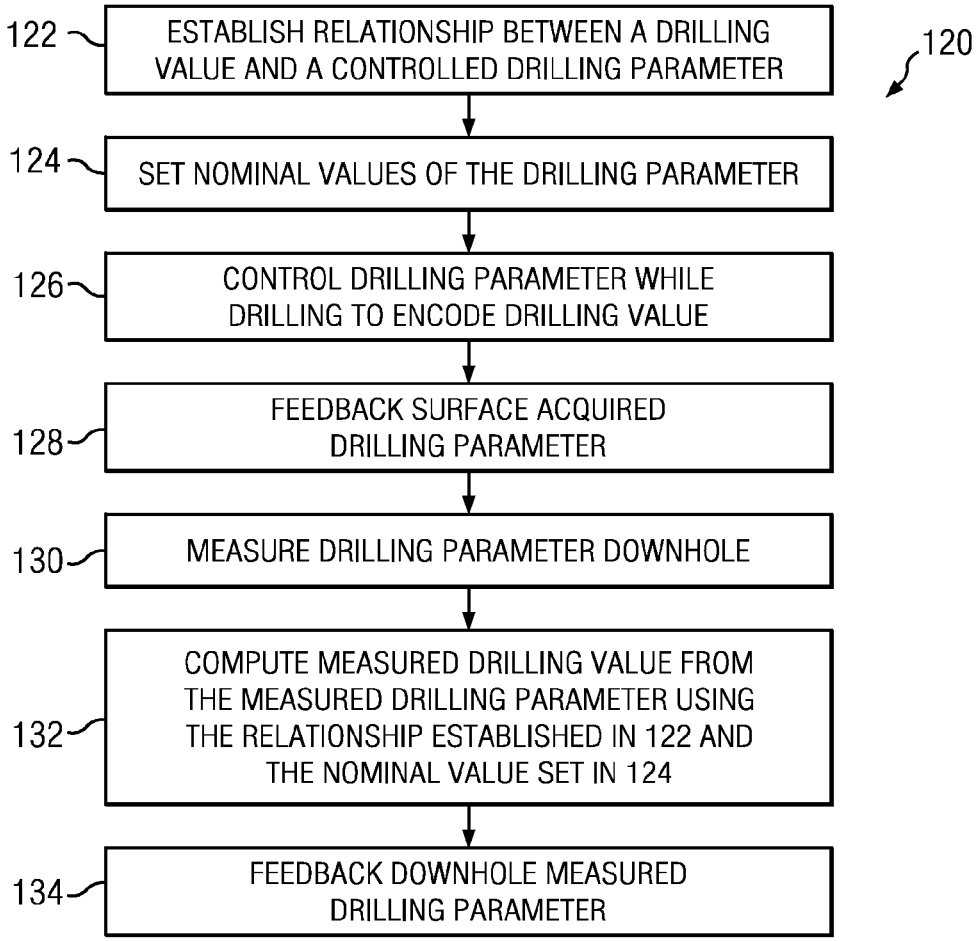
FIG. 3 depicts a flow chart of another example method embodiment.

FIG. 3 depicts a flow chart of another disclosed method embodiment 120. At 122 a relationship is established between an input signal (e.g., the acquired drilling value) to be downlinked and a drilling parameter to be varied at the surface. The establishing relationship defines the drilling value as a repeating (e.g., a periodic) function of the drilling parameter. At 124 a nominal value of the drilling parameter is selected (set) based upon the details of the drilling operation and the drilling process being utilized. The nominal value may be, for example, the midpoint of a selected period of the established repeating function. The nominal value may be encoded at the surface prior to beginning the drilling operation or may be downlinked using conventional downlinking methods. While drilling the drilling parameter is controlled at 126 to encode the acquired drilling value based upon the relationship established in 122. The controlled drilling parameter may be measured at the surface at 128 and processed in combination with a drill string model to obtain an estimate of the acquired drilling value received downhole. This estimate may optionally be used in a feedback loop to improve the control of the drilling parameter. The control drilling parameter is measured downhole at 130 and processed to compute the acquired drilling value at 132 using the relationship established in 122 and the nominal values of the drilling parameter set in 124. The acquired drilling value computed at 132 may be optionally transmitted to the surface at 134 using conventional up linking methods (e.g., mud pulse telemetry) to establish a feedback loop from the downhole tool to the surface to improve the control of the drilling parameter.

With continued reference to FIG. 3, the acquired drilling value may include substantially any suitable surface measurement, for example, including WOB, ROP, or measured depth. The controlled drilling parameter may also include substantially any suitable drilling parameter or combination of drilling parameters, for example, including the drill string rotation rate (RPM) and/or the pressure or flow rate of the drilling fluid at the mud pumps.

In power drilling applications the controlled drilling parameter may include a combination of drilling parameters (e.g., the aforementioned combination of drill string rotation rate and drilling fluid pressure at the mud pumps). The use of the term "power drilling" herein refers to drilling applications in which the drill string is rotated at the surface and a downhole drilling motor provides a differential rotation to a steering tool such as a rotary steerable tool and the drill bit. In such applications drill string components deployed above the drilling motor rotate with the drill string, while tools deployed below the motor rotate at a rate equal to the rotation rate of the drill string plus the differential rotation provided by the motor (which is related to the drilling fluid flow rate and therefore the drilling fluid pressure at the mud pumps).

In such power drilling applications, the drill string rotation rate and the drilling fluid pressure (flow rate) may be controlled together (in unison) to cause a desired rotation rate at the steering tool (and drill bit). This rotation rate may be measured downhole at 130 and used to compute the drilling value at 132. Moreover, the measured rotation rate may be uplinked back to the surface to provide the feedback at 134. The drill string rotation rate and/or the drilling fluid pressure may optionally be adjusted in response to the feedback.

Figure 4:
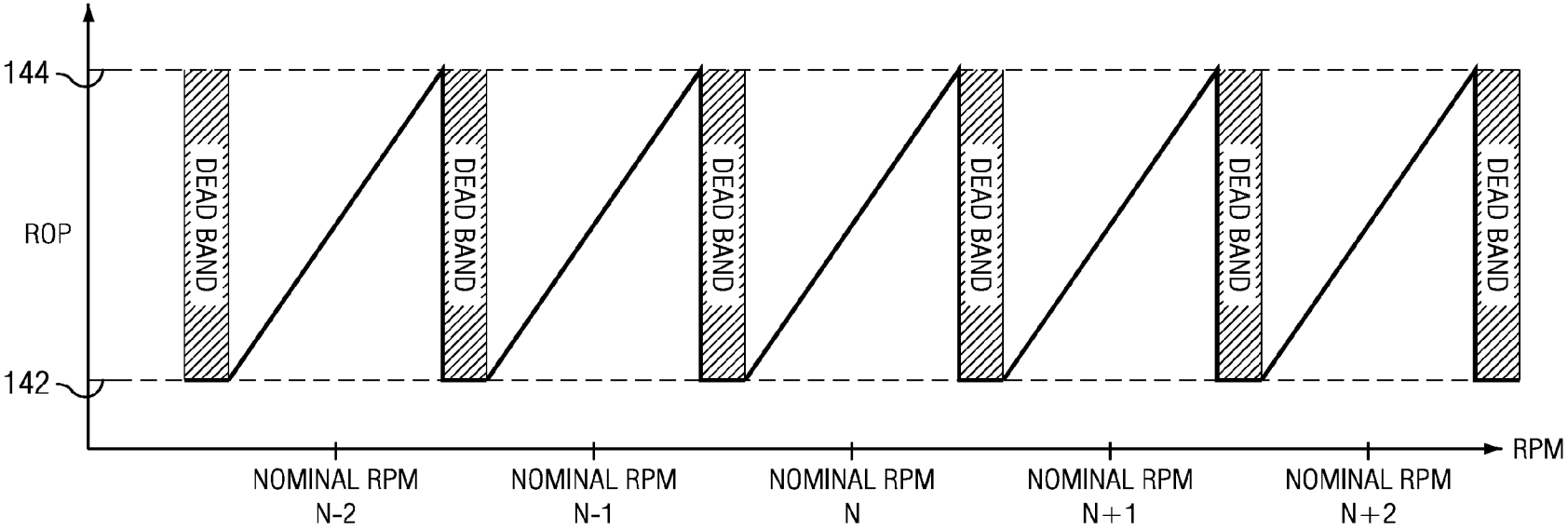
FIG. 4 depicts a plot of rate of penetration (ROP) versus drill string rotation rate (RPM) illustrating a relationship between the parameter to be downlinked and the drilling parameter to be varied.

FIG. 4 depicts a plot of ROP vs RPM and thus depicts one example of establishing the relationship at 122 and setting the nominal values at 124 (of FIG. 3). In the depicted embodiment, a repeating linear relationship between the ROP and the RPM is established between lower and upper ROP thresholds 142 and 144. It will of course be understood that the disclosed embodiments are not limited to a linear relationship. Nor are they limited to any particular values for thresholds 142 and 144. In certain embodiments the relationship may be a periodic function within a predetermine range of drilling parameter values (e.g., within a predetermine range of RPM in FIG. 4). By periodic it is meant that the function repeats itself at certain intervals (e.g., that ROP repeats at certain intervals of RPM as in FIG. 4). Those of ordinary skill will readily appreciate that such a periodic relationship may be expressed mathematically, for example, as follows: $f(x)=f(x+nP)$ where P represents the period. In the example shown on FIG. 4 the periodic relationship may be expressed mathematically, for example, as follows: ROP=$f$(RPM+nP).

Using a repeating and/or periodic relationship enables a single drilling value to be encoded using a plurality of drilling parameter values (e.g., using one drilling parameter value in each period of the relationship). Thus the desired drill string rotation rate for the drilling process may be selected from any of a number of nominal RPM values. The ROP may then be encoded within the corresponding RPM window (period) via making relatively small variations to the RPM (in accordance with the established relationship between ROP and RPM). The dead band regions 148 provide a buffer between adjacent RPM windows and may be used, for example, for reaming and other non-downlinking operations.

It will be understood that the use of a repeating and/or periodic relationship to encode the drilling value advantageously enables the controlled drilling parameter (in this case the RPM) to be grossly changed while drilling to optimize the drilling process (e.g., to change the ROP or to mitigate adverse drilling dynamics conditions) without changing the encoded drilling value (in this case ROP). For example, in an event in which reducing RPM is desired, the RPM may be reduced from N to N−1 or N−2 (and so on) without changing the encoded ROP value. Conversely, the RPM may be increased from N to N+1 or N+2 (and so on) without changing the encoded ROP value. In the depicted embodiment the RPM windows may be spaced in any suitable RPM interval, for example, in a range from about 10 to about 50 RPM. The disclosed embodiments are not limited in this regard.

It will of course be understood that the disclosed embodiments are not limited to the ROP vs RPM example shown on FIG. 4. Similar relationships may also be established between (i) weight on bit and RPM and/or drilling fluid pressure, (ii) ROP and RPM and/or drilling fluid pressure, (iii) applied torque and RPM and/or drilling fluid pressure, and (iv) and measured depth and RPM and/or drilling fluid pressure.

Figure 5:
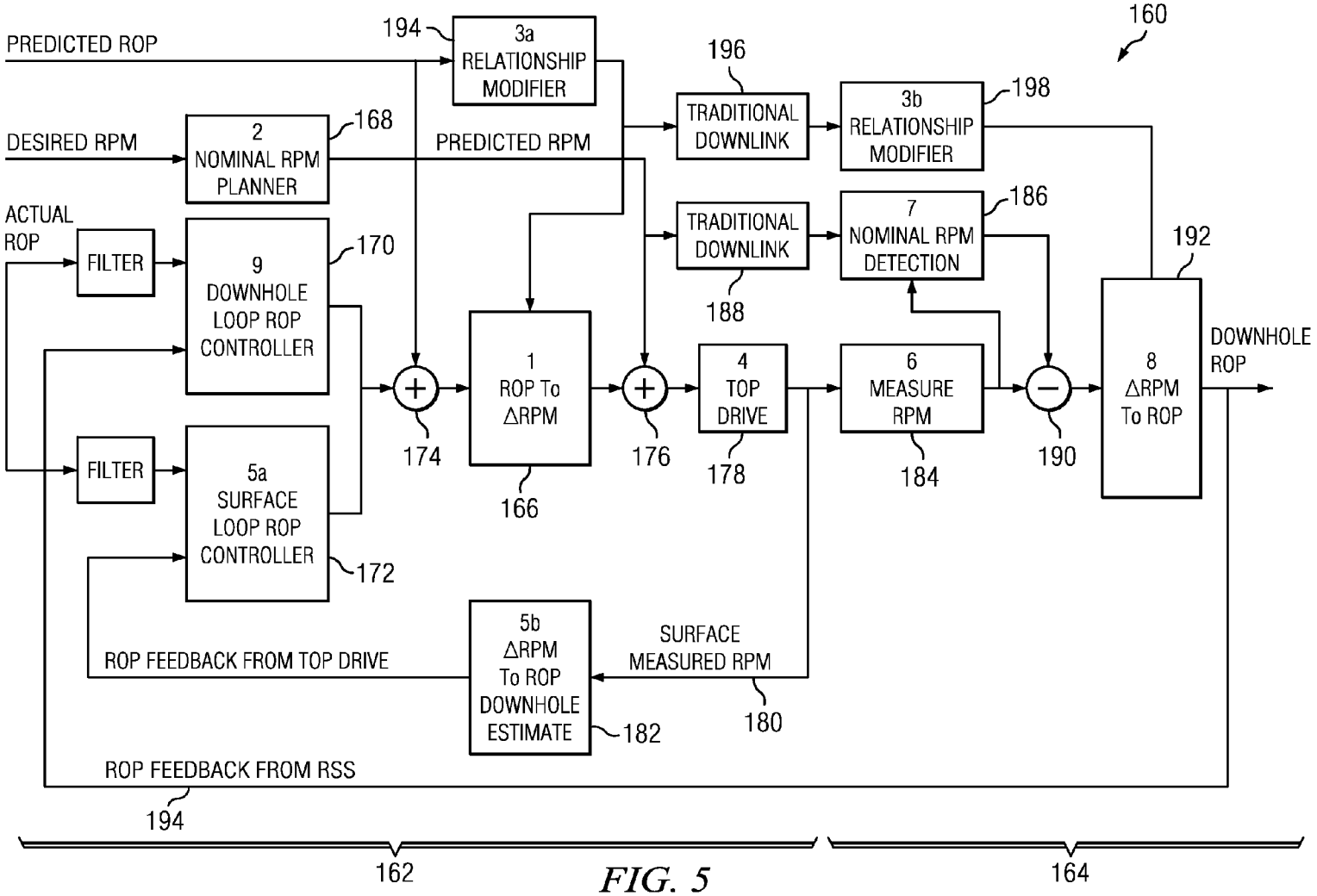
FIG. 5 depicts a block diagram of still another example method embodiment for continuously downlinking ROP.

FIG. 5 depicts a block diagram of still another example method embodiment 160 for continuously downlinking a drilling value such as ROP. In the depicted embodiment, steps that are performed uphole are indicated at 162 while steps performed downhole are indicated at 164. Method 160 is similar to method 120 in that a mathematical relationship is established between the ROP and ΔRPM at 166 (in which ΔRPM represents the deviation from the nominal RPM). The disclosed embodiments are not limited to ROP vs. RPM as described above. The desired RPM for the drilling operation is input into a nominal RPM planner at 168 to obtain a nominal RPM. The measured ROP may be filtered (e.g., time averaged) and input into downhole and surface loop ROP controllers at 170 and 172. The outputs may be summed (or averaged) at 174 and received at 166. The ΔRPM computed at 166 is combined (e.g., added) with the nominal RPM at 176 to obtain a controlled RPM for the top drive 178. The actual top drive rotation rate may be measured at the surface and processed, for example, using a drill string model to obtain a downhole ROP estimate (i.e., an estimate of the surface ROP value that was downlinked) at 182 which is in turn fed back into the surface loop ROP controller at 172.

With continued reference to FIG. 5, the RPM is measured downhole at 184 and processed at 186 to obtain the nominal RPM. The nominal RPM may also be received at 186 via conventional downlink at 188. The measured and nominal RPM values are processed at 190 to obtain ΔRPM which is in turn processed to compute the ROP at 192. The computed ROP value may be transmitted to the surface via conventional telemetry uplink methods at 194 and received at the downhole loop ROP controller 170. It will be understood that the feedback provided from the downhole steering tool at 194 is not necessarily the downlinked drilling value (e.g., ROP as indicated on FIG. 5). For example, when the drilling value is an acquired ROP, the feedback parameter may be a measured depth value that is obtained via integrating ROP. The surface process may close the loop, for example, by comparing the uplinked measured depth with a surface measured value or by differentiating the uplinked measured depth to obtain ROP.

Method 160 may further include receiving a predicted ROP (e.g., via a drilling model) at 174 and at a relationship modifier 194. The relationship modifier processes the predicted ROP to obtain a modified relationship (e.g., a new slope or linear constant) between the ROP and ΔRPM which is in turn forwarded to 166. The modified relation may be further downlinked at 196 to a corresponding downhole decoder 198 using conventional downlinking methods. The modified relation may then be used at 192 to compute the ROP values.

Although continuous downlinking while drilling methods and certain advantages thereof have been described in detail, it should be understood that various changes, substitutions and alternations can be made herein without departing from the spirit and scope of the disclosure as defined by the appended claims.

What is claimed is:

1. A method for downlinking acquired values from a surface location to a bottom hole assembly, the method comprising:

(a) causing the bottom hole assembly to drill a subterranean wellbore;

(b) acquiring a drilling value at a surface location; and (c) downlinking the drilling value acquired in (b) from the surface location to the bottom hole assembly, wherein said downlinking includes (i) establishing a relationship between the drilling value and a drilling parameter in which multiple nominal values of the drilling parameter correspond to a single drilling value; (ii) selecting a nominal value of the drilling parameter; (iii) controlling the drilling parameter while drilling to encode the drilling value; (iv) measuring the drilling parameter downhole; and (v) processing the drilling parameter acquired in (iv) to compute the drilling value downhole.

2. The method of claim 1, wherein the drilling value is weight on bit, rate of penetration, or measured depth.

3. The method of claim 1, wherein:

(c)(iii) comprises controlling first and second drilling parameters while drilling to encode the drilling value; and (c)(iv) comprises measuring one of the first and second drilling parameters downhole.

4. The method of claim 3, wherein:

the first and second drilling parameters controlled in (iii) are drill string rotation rate and drilling fluid pressure; and the drilling parameter measured in (iv) is the drill string rotation rate.

5. The method of claim 1, wherein the relationship established in (i) is a repeating mathematical function.

6. The method of claim 1, wherein the relationship established in (i) is a periodic mathematical function.

7. The method of claim 1, wherein the drilling value is rate of penetration and the drilling parameter is drill string rotation rate.

8. The method of claim 1, further comprising:

(d) continuously repeating (b), (c)(iii), (c)(iv), and (c)(v) while drilling in (a).

9. A method for downlinking information from a surface location to a bottom hole assembly, the method comprising:

(a) establishing a mathematical relationship between an acquired drilling value to be downlinked and a drilling parameter to be controlled, wherein the mathematical relationship is a repeating function;

(b) causing the bottom hole assembly to drill a subterranean wellbore;

(c) measuring the drilling value at a surface location;

(d) controlling the drilling parameter while drilling to encode the drilling value according to the relationship established in (a);

(e) measuring the drilling parameter downhole; and (f) processing the drilling parameter measured in (e) to compute the drilling value downhole.

10. The method of claim 9, further comprising:

(g) continuously repeating (c), (d), (e), and (f) while drilling in (b).

11. The method of claim 9, wherein (a) further comprises selecting a nominal value of the drilling parameter.

12. The method of claim 11, further comprising:

(g) changing the nominal value of the drilling parameter from a first nominal value to a second nominal value while drilling in (b) without changing the drilling value encoded in (d).

13. The method of claim 9, wherein the drilling value is weight on bit, rate of penetration, or measured depth and the drilling parameter is drill string rotation rate or drilling fluid pressure.

14. The method of claim 9, wherein the relationship is a linear relationship.

15. The method of claim 9, wherein the repeating function is a periodic function.

16. The method of claim 9, wherein the drilling parameter is measured at the surface in (d) and processed to obtain an estimate of the drilling value computed downhole in (f).

17. The method of claim 16, wherein the estimate of the drilling value is processed in a feedback loop to improve control of the drilling parameter in (d).

18. The method of claim 9, further comprising:

(g) uplinking the drilling value computed in (f) to the surface location.

19. The method of claim 18, further comprising:

(h) processing said uplinked drilling value in a feedback loop to improve control of the drilling parameter in (d).

20. The method of claim 9, wherein (c) and (d) in combination further comprise:

(i) making continuous measurements of the drilling value at a first time interval at the surface location;

(ii) processing the drilling value measurements made in (i) to compute a time-averaged drilling value at a second time interval; and (iii) controlling the drilling parameter while drilling to encode the time-averaged drilling value according to the relationship established in (a).

21. A method for downlinking information from a surface location to a bottom hole assembly, the method comprising:

(a) establishing a periodic mathematical relationship between a measured rate of penetration while drilling to be downlinked and a drill string rotation rate to be controlled;

(b) selecting a nominal drill string rotation rate;

(c) causing the bottom hole assembly to drill a subterranean wellbore;

(d) measuring the rate of penetration at a surface location;

(e) controlling the drill string rotation rate while drilling in (c) to encode the rate of penetration in a difference between the drill string rotation rate and the nominal drill string rotation rate selected in (b);

(f) measuring the drill string rotation rate at the surface;

(g) processing the drill string rotation rate measured in (f) to obtain an estimate of the rate of penetration computed downhole at (j);

(h) processing the estimate of the rate of penetration obtained in (g) in a feedback loop to improve control of the drill string rotation rate in (e);

(i) measuring the drill string rotation rate downhole;

(j) processing the drill string rotation rate measured in (i) to compute the rate of penetration downhole;

(k) uplinking the rate of penetration computed in (j) to the surface location; and (l) processing said rate of penetration uplinked in (k) in a feedback loop to improve control of the drill string rotation rate in (e).

22. A method for downlinking acquired values from a surface location to a bottom hole assembly, the method comprising:

(a) causing the bottom hole assembly to drill a subterranean wellbore;

(b) acquiring a drilling value at a surface location;

(c) controlling a drill string rotation rate and a drilling fluid pressure while drilling in (a) to encode the drilling value;

(d) measuring a drill string rotation rate downhole; and (e) processing the drill string rotation rate measured in (d) to compute the drilling value downhole.

* * * * *